US008500421B2

(12) United States Patent
Domash et al.

(10) Patent No.: US 8,500,421 B2
(45) Date of Patent: Aug. 6, 2013

(54) SYSTEM AND METHOD OPERABLE TO PREVENT TUBING DISPLACEMENT WITHIN A PERISTALTIC PUMP

(75) Inventors: David Domash, Irvine, CA (US); Mark Hopkins, Mission Viejo, CA (US); Nader Nazarifar, Laguna Niguel, CA (US)

(73) Assignee: Novartis AG, Basel (CH)

( * ) Notice: Subject to any disclaimer, the term of this patent is extended or adjusted under 35 U.S.C. 154(b) by 1271 days.

(21) Appl. No.: 11/618,840

(22) Filed: Dec. 31, 2006

(65) Prior Publication Data

US 2008/0240951 A1 Oct. 2, 2008

Related U.S. Application Data

(60) Provisional application No. 60/755,607, filed on Dec. 31, 2005.

(51) Int. Cl.
*F04B 43/08* (2006.01)
*F04B 43/12* (2006.01)

(52) U.S. Cl.
USPC ..... 417/477.2; 604/153

(58) Field of Classification Search
USPC ..... 417/477.2, 477.5, 477.9, 477.12; 604/153
See application file for complete search history.

(56) References Cited

U.S. PATENT DOCUMENTS 2,917,002 A * 12/1959 Mascaro ..... 417/477.5
4,201,525 A * 5/1980 Brown et al. ..... 417/477.5
4,392,794 A * 7/1983 Foxcroft ..... 417/475
6,293,926 B1 * 9/2001 Sorensen et al. ..... 604/153
6,962,488 B2 * 11/2005 Davis et al. ..... 417/477.2

* cited by examiner

*Primary Examiner* — Peter J Bertheaud
(74) *Attorney, Agent, or Firm* — Darien Reddick

(57) ABSTRACT

Embodiments to the present invention provide a peristaltic pump. This peristaltic pump includes a flexible flow path, an exterior casing, an elastomeric member, and a number of rollers driven by a motor. The exterior casing and elastomeric member have a first and second annular recess, respectively. An annular flow path guide is formed when the exterior casing and elastomeric member are mechanically coupled. Rollers move along the annular flow path to compress and release the flexible flow path and in so doing draw fluid through the flexible flow patch to achieve pumping action. Mechanical guides proximate to the first annular recess and second annular recess prevent relative motion between the first annular recess and second annular recess ensuring that the flexible flow path remains in place.

12 Claims, 4 Drawing Sheets

SYSTEM AND METHOD OPERABLE TO PREVENT TUBING DISPLACEMENT WITHIN A PERISTALTIC PUMP

RELATED APPLICATIONS

This application claims the benefit of, priority to, and incorporates by reference in its entirety for all purposes U.S. Provisional Application No. 60/755,607 entitled "SYSTEM AND METHOD OPERABLE TO PREVENT TUBING DISPLACEMENT WITHIN A PERISTATLTIC PUMP" filed on 31 Dec. 2005.

TECHNICAL FIELD OF THE INVENTION

The present invention relates generally to pumps, and more particularly, a system and method operable to prevent the displacement of flexible tubing within a peristaltic pump.

BACKGROUND OF THE INVENTION

Peristaltic pumps offer many advantages over other pumping systems. Primarily peristaltic pumps offer increased cleanliness. Such pumps have no valves, seals or glands, and the fluid only contacts the interior of a flexible tube or flexible flow path. This greatly reduces the risk of contaminating fluid to be pumped or fluid contaminating the pump itself. Within a peristaltic pump fluid is drawn into a flexible tube or flexible flow path and trapped between two shoes or rollers before finally being expelled from the pump. The complete closure of the flexible tubing or flow path is squeezed between the shoes or rollers to provide a positive displacement action and prevent backflow eliminating the need for check valves when the pump is running. Such pumps have a variety of applications including medical, pharmaceutical, chemical, or any other industry or any other like application where non-contamination is important. However, the flexible hose or flow path within the pump can be dislodged within the pump creating a situation where the metered action of the peristaltic pump is defeated or potentially allowing backflow. Therefore, an improved means of preventing free flow within the flexible flow path or backflow within the flexible flow path is desirable.

The advantages of peristaltic pumps are that the components of the pump may be chosen when the integrity of the media is a requirement of the application since the fluid type does not contact any internal parts. Seals and valves are not needed as in other pumps. Many peristaltic pumps come with wash down capabilities and/or IP54 or IP55 ratings.

SUMMARY OF THE INVENTION

Embodiments to the present invention provide a peristaltic pump. This peristaltic pump includes a flexible flow path, an exterior casing, an elastomeric member, and a number of rollers driven by a motor. The exterior casing and elastomeric member have a first and second annular recess, respectively. An annular flow path guide is formed when the exterior casing and elastomeric member are mechanically coupled. Rollers move along the annular flow path to compress and release the flexible flow path and in so doing draw fluid through the flexible flow patch to achieve pumping action. Mechanical guides proximate to the first annular recess and second annular recess prevent relative motion between the first annular recess and second annular recess ensuring that the flexible flow path remains in place.

BRIEF DESCRIPTION OF THE DRAWINGS

For a more complete understanding of the present invention and the advantages thereof, reference is now made to the following description taken in conjunction with the accompanying drawings in which like reference numerals indicate like features and wherein.

DESCRIPTION OF THE INVENTION

Preferred embodiments of the present invention are illustrated in the FIGS., like numerals being used to refer to like and corresponding parts of the various drawings.

Figure 1:
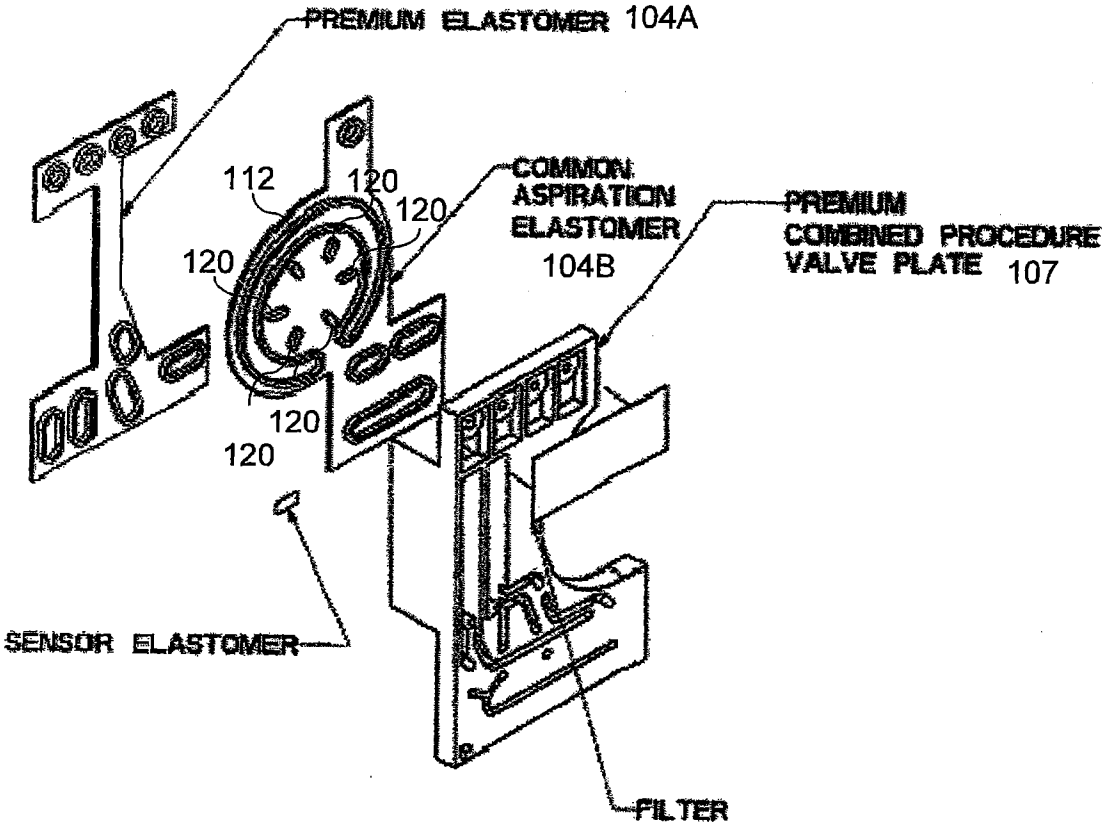
FIGS. 1, 2 and 3, which provide an exploded view of the peristaltic pump.
Figure 2:
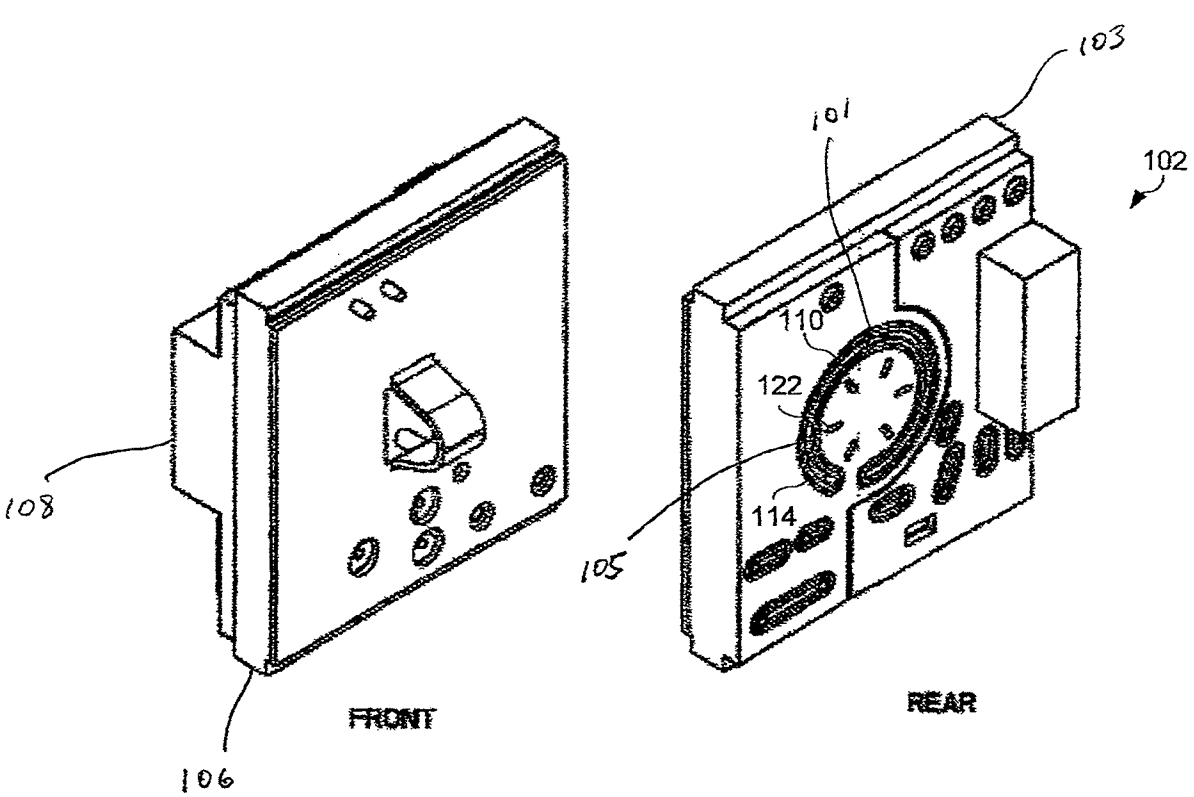
Figure 3:
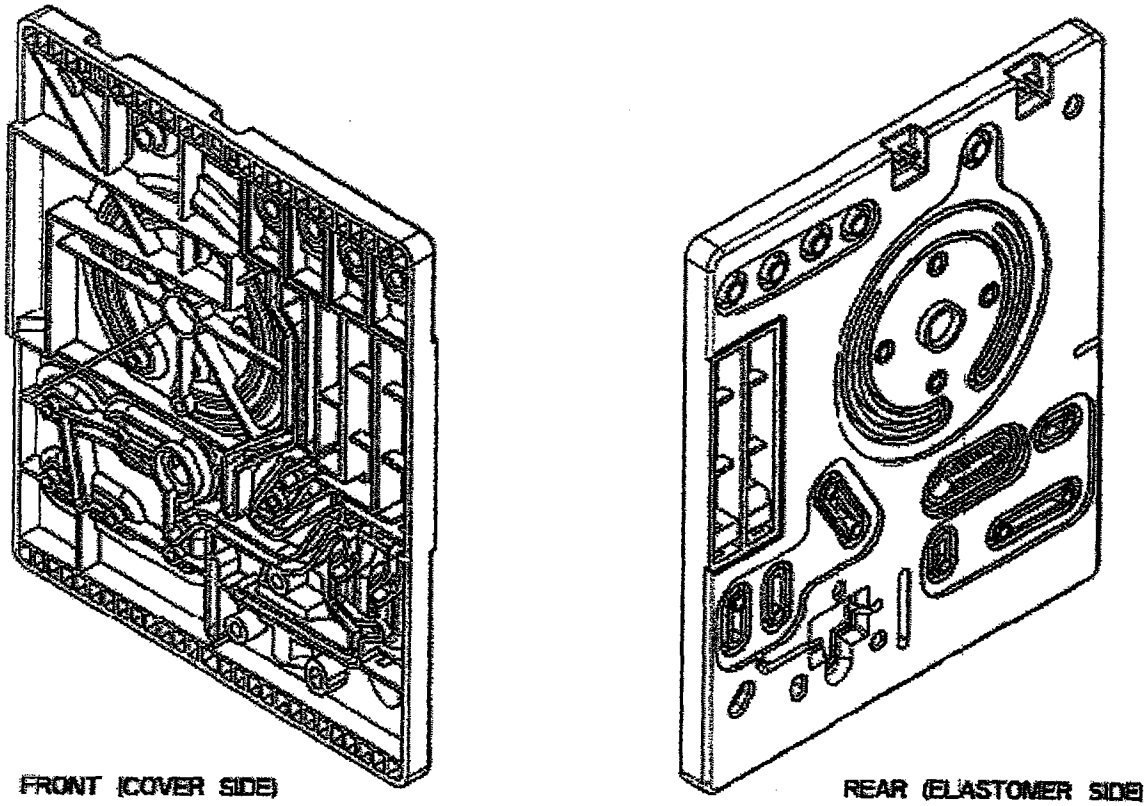

Embodiments of the present invention provide a peristaltic pump. One embodiment of this peristaltic pump is depicted in FIGS. 1, 2 and 3, which provide an exploded view of the peristaltic pump. This peristaltic pump includes a cassette 102 having an exterior casing 103 and elastomeric members 104A, 104B (Shown in FIG. 1). The cassette may have a front and rear cover 106 and 108, respectively and a valve plate 107. The cassette receives a flexible flow path, such as a flexible tube or hose, which may be routed by various pins and flow guides within the cassette. Within an annular flow path guide 105 is an annular flow path 110. This annular flow path 110 may be formed by a first annular recess 112 within the elastomeric member 104B and an annular recess 114 within the exterior casing of the cassette. Rollers may rotate along the annular flow path 110. Rollers press against flexible hose within the annular flow path guide 105 to compress the annular flow path 110. Media or fluid within the tubing is then moved through the tube by the positive displacement motion created by the rotating motion of rollers which may be driven by an external motor which is not shown. Such a pump provides the ability to provide accurate metered doses to dispense accurate and measured volumes of fluid. However, should the hose move with respect to the annular flow path guide 105, a free flow of fluid may result or the potential back flow of fluid may result. To prevent this backflow, mechanical guide features 120 on the elastomeric member 104B mate with recesses or other mechanical features in the exterior casing of the cassette 102. For example, in the cassette face shown in FIG. 2, guide pin holes 122 may receive the mechanical guide features 120. By mating these mechanical features of the elastomeric member 104B to corresponding features within the exterior casing of the cassette, relative motion or movement of the elastomeric member to the cassette may be greatly reduced, improving the overall performance of the peristaltic pump.

To further assist in the precise delivery of fluids using the peristaltic pump of the present invention, sensors may monitor flow within the flexible flow path. A controller monitoring the sensed flow may use pinch valves or other like devices to halt or restrict flow if necessary.

Figure 4:
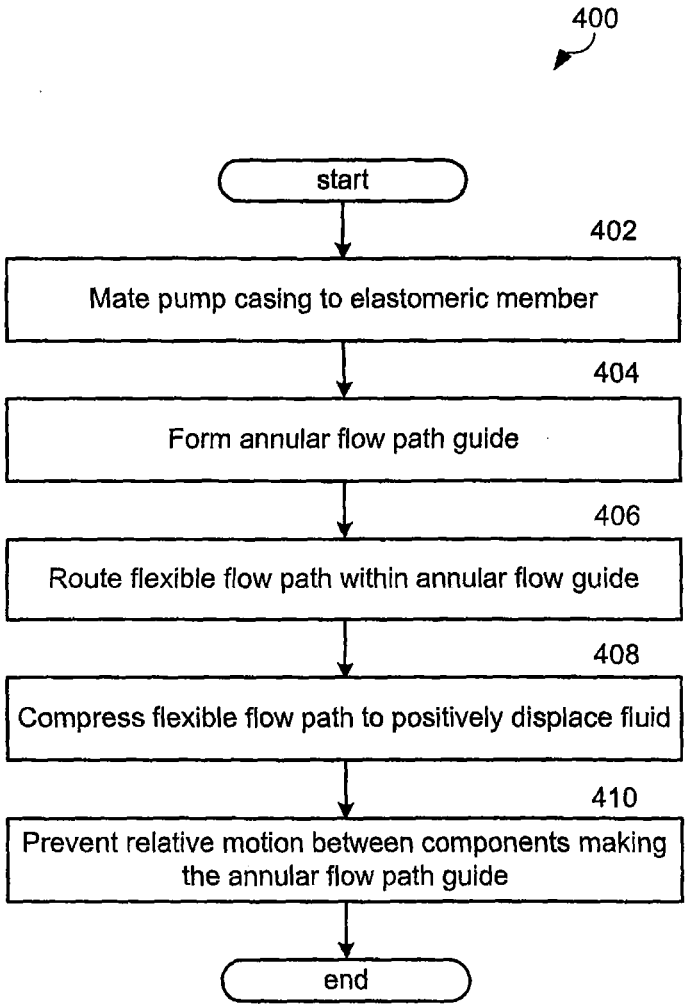
FIG. 4 is a logic flow diagram associated with a method of pumping fluid with a peristaltic pump in accordance with the embodiment of the present invention.

FIG. 4 provides a method of pumping fluid with a peristaltic pump in accordance with the embodiment of the present invention. These operations 400 commence with Step 402, where an exterior pump casing is mated to an elastomeric member when both the exterior pump casing and elastomeric member have an annular recess. These annular recesses form an annular flow path guide 105 in Step 404. Flexible hose or tubing is routed through the annular flow path guide 105 in Step 406. Step 408 compresses the flexible flow path between the annular flow path guide 105 and at least one roller to positively displace fluid contained within the compressed flexible flow path. In Step 410, relative motion between the first annular recess and second annular recess is prevented to ensure that the flexible hose or tubing remains in place within the peristaltic pump. This prevents the free unmetered flow of fluids within the peristaltic pump which would result in an improper dosage being supplied in a medical or pharmaceutical application In summary, embodiments of the present invention provide a peristaltic pump. This peristaltic pump includes a flexible flow path, an exterior casing, an elastomeric member, and a number of rollers driven by a motor. The exterior casing and elastomeric member have a first and second annular recess, respectively. An annular flow path guide is formed when the exterior casing and elastomeric member are mechanically coupled. Rollers move along the annular flow path to compress and release the flexible flow path and in so doing draw fluid through the flexible flow patch to achieve pumping action. Mechanical guides proximate to the first annular recess and second annular recess prevent relative motion between the first annular recess and second annular recess ensuring that the flexible flow path remains in place to prevent backflow or other flow irregularities.

As one of average skill in the art will appreciate, the term "substatially" or "approximately", as may be used herein, provides an industry-accepted tolerance to its corresponding term. Such an industry-accepted tolerance ranges from less than one percent to twenty percent and corresponds to, but is not limited to, component values, integrated circuit process variations, temperature variations, rise and fall times, and/or thermal noise. As one of average skill in the art will further appreciate, the term "operably coupled", as may be used herein, includes direct coupling and indirect coupling via another component, element, circuit, or module where, for indirect coupling, the intervening component, element, circuit, or module does not modify the information of a signal but may adjust its current level, voltage level, and/or power level. As one of average skill in the art will also appreciate, inferred coupling (i.e., where one element is coupled to another element by inference) includes direct and indirect coupling between two elements in the same manner as "operably coupled". As one of average skill in the art will further appreciate, the term "compares favorably", as may be used herein, indicates that a comparison between two or more elements, items, signals, etc., provides a desired relationship. For example, when the desired relationship is that signal 1 has a greater magnitude than signal 2, a favorable comparison may be achieved when the magnitude of signal is greater than that of signal 2 or when the magnitude of signal 2 is less than that of signal 1.

Although the present invention is described in detail, it should be understood that various changes, substitutions and alterations can be made hereto without departing from the spirit and scope of the invention as described.

What is claimed is:

1. A peristaltic pump, comprising:

an exterior casing;

a plurality of mating features formed in the exterior easing;

an elastomeric member disposed within the exterior casing, the elastomeric member comprising:

a plurality of mechanical guide features; and a first annular recess, a second annular recess formed in the exterior casing; and an annular flow path guide formed by the first annular recess and the second annular recess, the annular flow path guide defining an annular flow path, wherein the plurality of mechanical guide features are received into the plurality of mating features, the plurality of mating features and the plurality of mechanical guide features cooperating to prevent relative motion between the elastomeric member and the exterior casing, and wherein the annular flow path guide is configured to engage at least one roller, wherein the at least one roller is operable to move along the annular flow path guide, and pinch the annular flow path creating a positive displacement of fluid contained within the annular flow path.

2. The peristaltic pump of claim 1, further comprising at least one pinch valve operable to restrict flow within the annular flow path.

3. The peristaltic pump of claim 1, further comprising a sensor elastomer operable to measure fluid flow within the annular flow path.

4. The peristaltic pump of claim 1, further comprising a valve plate.

5. The peristaltic pump of claim 1, wherein the plurality of mechanical guide features are integrally formed in the elastomeric member.

6. The peristaltic pump of claim 1, wherein the exterior casing comprises a front cover and a rear cover and wherein the second annular recess is formed in the rear cover.

7. The peristaltic pump of claim 1, wherein the plurality of mating features formed in the exterior casing are a plurality of openings, wherein the plurality of mechanical guide features are a plurality of protrusions integrally formed in the elastomeric member, and wherein receiving the plurality of mechanical guide features into the plurality of mating features comprises accepting the plurality of protrusions into the plurality of openings.

8. The peristaltic pump of claim 1, wherein the exterior casing comprises a front cover and a rear cover.

9. A method of pumping fluid with a peristaltic pump, the method comprising:

mating an elastomeric member comprising a first annular recess and a plurality of mechanical guide features with an exterior easing comprising a second annular recess and a plurality of mating features;

receiving the plurality of mechanical guide features into the plurality of mating features;

forming an annular flow path guide with the first annular recess and the second annular recess, the annular flow path defining an annular flow path;

compressing the annular flow path with at least one roller to positively displace fluid contained within the compressed annular flow path; and preventing relative motion between the first annular recess and the second annular recess by the cooperative engagement of the plurality of mating features and the plurality of mechanical guide features.

10. The method of claim 9, wherein the plurality of mechanical features are proximate to the first annular recess.

11. The method of claim 9, further comprising restricting flow within the annular flow path with at least one pinch valve.

12. The method of claim 9, further comprising measuring fluid flow within the annular flow path with a sensor.

* * * * *